United States Patent [19]

Matsushita et al.

[11] Patent Number: 4,568,956

[45] Date of Patent: Feb. 4, 1986

[54] HEAT-SENSITIVE AND HEAT TRANSFER RECORDING SHEET WITH PRESSURE SENSITIVITY

[75] Inventors: Toshihiko Matsushita, Tokyo; Sadao Morishita, Inashiki; Mikiya Sekine, Warabi, all of Japan

[73] Assignee: Mitsubishi Paper Mills, Ltd., Tokyo, Japan

[21] Appl. No.: 700,386

[22] Filed: Feb. 11, 1985

[30] Foreign Application Priority Data

Feb. 13, 1984 [JP] Japan ..... 59-25329

[51] Int. Cl.[4] ..... B41M 5/18

[52] U.S. Cl. ..... 346/204; 346/214; 346/226; 427/150; 427/151; 427/152; 428/488.4; 428/913; 428/914

[58] Field of Search ..... 346/200, 204, 214, 215, 346/226; 427/150, 151, 152; 428/488.4, 913, 914

[56] References Cited

U.S. PATENT DOCUMENTS

| | | | |
|---|---|---|---|
| 3,996,405 | 12/1976 | Porter | 427/150 |
| 4,063,754 | 12/1977 | Shackle et al. | 427/151 |
| 4,352,855 | 10/1982 | Hiraishi et al. | 428/914 |
| 4,520,376 | 5/1985 | Morishita et al. | 346/204 |

*Primary Examiner*—Bruce H. Hess

*Attorney, Agent, or Firm*—Cushman, Darby & Cushman

[57] ABSTRACT

A colorless, heat-sensitive and heat transfer recording sheet with pressure sensitivity comprising a base sheet, a heat-sensitive recording layer provided on one side of the base sheet and a heat transfer recording layer provided on the other side of the base sheet, the heat transfer recording layer being formed by coating on the base sheet a coating color comprising 3 to 20 parts by weight of microcapsules containing a colorless, electron-donating color former, 3 to 30 parts by weight of microcapsules containing a colorless, electron-accepting color developer, 3 to 30 parts by weight of a solid of a colorless, electron-donating, color former, 10 to 50 parts by weight of a solid of a colorless, electron-accepting, color developer and 25 to 200 parts by weight of a wax.

When this recording sheet is superimposed on a plain paper and thermal printing is made on the recording sheet, there can be formed an image on the heat-sensitive recording layer of the recording sheet and, at the same time, a clear, heat transferred image on the plain paper. When the same combination of the above recording sheet and the above plain paper is subjected to pressure printing on the recording sheet, there can be formed a pressure transferred image on the plain paper.

3 Claims, No Drawings

HEAT-SENSITIVE AND HEAT TRANSFER RECORDING SHEET WITH PRESSURE SENSITIVITY

BACKGROUND OF THE INVENTION (1) Field of the Invention

This invention relates to a heat-sensitive and heat transfer recording sheet with pressure sensitivity.

(2) Description of the Prior Art

In recent years, in addition to the conventional heat-sensitive recording method using a thermal recording equipment such as a thermal printer, a thermal facsimile or the like, there has been put into practical use a heat transfer recording method having advantages such as retainability after recording, indelibility, solvent resistance and the like. In the latter method, a heat transfer recording sheet consisting of a base sheet and a heat-meltable ink layer coated on one side of the base sheet is superimposed on a plain paper so that the ink layer side of the recording sheet faces the plain paper; then, heat is applied onto the heat transfer recording sheet by a thermal head of a thermal facsimile or the like; thereby the ink of the heat transfer recording sheet is transferred onto the plain paper and thus recording is made. Heat transfer recording in a single color (e.g. black color) is already in practical use.

There is also a heat-sensitive and heat transfer recording sheet obtained by providing a heat-sensitive color-developing layer on the non-coated side of a heat transfer recording sheet. This heat-sensitive and heat transfer recording sheet enables multiple recording.

With respect to the heat transfer recording sheet, it has recently been desired that the sheet also have pressure sensitivity in order to enable, whenever necessary, pressure printing by a method such as hand writing, typewriting or the like. Hence, a heat-meltable ink also having pressure sensitivity is being studied.

However, having pressure sensitivity means being liable to cause staining during handling.

In the heat-sensitive and heat transfer recording sheet obtained by providing a heat-sensitive color-developing layer on the non-coated side of a heat transfer recording sheet, the heat-meltable ink of the heat transfer recording layer contains a color dye or color pigment and hence the heat transfer recording layer has a color. This color is seen through even at the heat-sensitive color-developing layer, and this "seen through" problem is not good from the appearance standpoint and reduces the readability of printed image. Therefore, improvements are under way.

For example, in Japanese Patent Application Kokai (Laid-open) No. 78793/1983, there is disclosed a heat recording copying sheet comprising a base sheet, a heat-sensitive color-developing layer provided on one side of the base sheet and a heat-meltable color ink layer provided on the other side of the base sheet. In this copying sheet, in order to prevent the "seen through" problem due to the heat-meltable color ink, a vapor deposition layer is provided on the base sheet before the heat-sensitive color-developing layer is provided. This makes the production of the copying sheet more complicated and incurs a higher production cost.

SUMMARY OF THE INVENTION

In order to solve the above mentioned drawbacks, the present inventors have conducted an extensive study. As a result, they have succeeded in providing a colorless, heat-sensitive and heat transfer recording sheet with pressure sensitivity comprising a base sheet, a heat-sensitive recording layer provided on one side of the base sheet and a heat transfer recording layer provided on the other side of the base sheet, the heat transfer recording layer being formed by coating on the base sheet a coating color essentially composed of 3 to 20 parts by weight of microcapsules containing a colorless, electron-donating color former, 3 to 30 parts by weight of microcapsules containing a colorless, electron-accepting color developer, 3 to 30 parts by weight of a solid of a colorless, electron-donating color former, 10 to 50 parts by weight of a solid of a colorless, electron-accepting color developer and 25 to 200 parts by weight of a wax. When the recording sheet of the present invention is superimposed on a plain paper so that the heat transfer recording layer of the recording sheet faces the plain paper and then heat is applied onto the recording sheet by the use of a thermal head, there are formed a clear image on the heat-sensitive recording layer of the recording sheet and, at the same time, a clear, heat transferred image on the plain paper. Further, when an external pressure is applied onto the above recording sheet superimposed on the plain paper, there is formed a pressure transferred image on the plain paper.

According to the present invention, there is obtained an advantage that, since both a colorless, electron-donating color former and a colorless, electron-accepting color developer capable of forming a color by reaction with the color former are partically encapsulated, when the heat-sensitive and heat transfer recording sheet of the present invention is superimposed on a plain paper and pressure printing is made on the heat-sensitive recording layer of the recording sheet by the use of a pen or the like, there can be obtained a pressure transferred image on the plain paper due to the color-developing reaction between the color former and the color developer.

According to the present invention, there is also obtained an advantage that, when the heat-sensitive and heat transfer recording sheet is superimposed on a plain paper and thermal printing is made on the heat-sensitive recording layer of the recording sheet by the use of a thermal head, there are conducted heat recording on the heat-sensitive recording layer of the recording sheet and heat transfer recording on the plain paper and thus duplicate copying can be conducted.

According to the present invention, there is further obtained an advantage that, since the heat transfer recording layer of the recording sheet essentially composed of a microencapsulated color former, a microencapsulated color developer, a solid color former, a solid color developer and a wax is colorless or only slightly colored, there occurs no "seen through" problem at the heat-sensitive recording layer in the recording sheet of the present invention and hence no countermeasure for the problem is required.

DETAILED DESCRIPTION OF THE INVENTION

The present invention will be described in detail below.

The heat-sensitive and heat transfer recording sheet according to the present invention is a sheet comprising a base sheet, a heat-sensitive recording layer provided on one side of the base sheet and a heat transfer recording layer provided on the other side of the base sheet, wherein the heat transfer recording layer is comprising microcapsules containing a colorless, electron-donating color former, microcapsules containing a colorless, electron-accepting color developer capable of forming a color by reaction with the color former, a solid of a colorless, color former, a solid of a colorless, color developer and a wax. When this recording sheet is superimposed on a plain paper so that the heat transfer recording layer of the recording sheet faces the plain paper and then a pressure is applied onto the heat-sensitive recording layer of the recording sheet by the use of a pen or the like, the microcapsules are broken and the contents therein react with each other to develop a color, whereby there is formed an image on the plain paper. Thus, the heat-sensitive and heat transfer recording sheet of the present invention has pressure sensitivity.

When the recording sheet of the present invention is superimposed on a plain paper in the same manner as above and then thermal printing is made on the recording sheet by the use of a thermal head, there are formed an image on the heat-sensitive layer of the recording sheet and, at the same time, a heat transferred image on the plain paper by the reaction between the solid color former and the solid color developer.

As the colorless, electron-donating color former used in the present invention, there can be mentioned, for example, Crystal Violet Lactone, Malachite Green Lactone, 3-diethylamino-7-methylfluoran, 3-diethylamino-6-methyl-7-chlorofluoran, 3-diethylamino-7-dibenzylaminofluoran, 3-diethylamino-7-anilinofluoran, 3-(N-methylanilino)-7-anilinofluoran, 3-diethylamino-7-(m-tirfluoromethylanilino)fluoran, 3-diethylamino-6-methyl-7-anilinofluoran, 3-(N-methylcyclohexylamino)-6-methyl-7-anilinofluoran, 3-pyrrolidino-6-methyl-7-anilinofluoran, 3-piperidino-6-methyl-7-anilinofluoran, 3-(N-methyl-p-toluidino)-6-methyl-7-anilinofluoran and benzo-$\beta$-naphthospiropyran.

As the colorless, electron-accepting color developer used in the present invention, there can be mentioned, for example, phenol, p-tert-butylphenol, p-phenylphenol, $\alpha$-naphthol, $\beta$-naphthol, benzyl p-hydroxybenzoate, 4,4'-isopropylidenediphenol, 4,4'-sec-butylidenediphenol, 4,4'-isopropylidenebis-(2-tert-butylphenol), 4,4'-cyclohexylidenediphenol, phenyl 4-hydroxybenzoate, novolak type phenolic resin, salicylic acid, 3-phenylsalicylic acid, 5-methylsalicylic acid and 3,5-di-tertbutylsalicylic acid.

As the wax used in the present invention, there can be mentioned, for example, paraffin wax, microcrystalline wax, bees wax, spermaceti, shellac wax, carnauba wax, candelilla wax, montan wax and low molecular polyethylene wax.

The microencapsulated color former and the microencapsulated color developer each used in the present invention are contained in microcapsules after having been dissolved in a non-volatile solvent. As the non-volatile solvent, there can be mentioned, for example, alkylnaphthalenes, chlorinated paraffins, diarylethanes, alkyldiphenyls, aromatic esters and aliphatic esters. In the case of microcapsules containing a color former, the inner phase solution inside the microcapsules consists preferably of 3 to 20% by weight of the color former and 97 to 80% by weight of a non-volatile solvent. In the case of microcapsules containing a color developer, the inner phase solution inside the microcapsules consists preferably of 20 to 50% by weight of the color developer and 80 to 50% by weight of a non-volatile solvent.

With respect to the composition of the coating color used for formation of the heat transfer recording layer used in the present invention, color former-containing microcapsules are 3 to 20 parts by weight, preferably 5 to 10 parts by weight; color developer-containing microcapsules are 3 to 30 parts by weight, preferably 5 to 20 parts by weight; a solid color former is 3 to 30 parts by weight, preferably 5 to 20 parts by weight; a solid color developer is 10 to 50 parts by weight, preferably 15 to 35 parts by weight; and a wax is 25 to 200 parts by weight, preferably 40 to 100 parts by weight.

As the heat-sensitive recording layer used in the present invention, there can be used those employed in ordinary heat-sensitive sheets. Specific examples of the heat-sensitive recording layer of the present invention are as follows.

The color former and the color developer each used in the heat-sensitive recording layer are selected among the color formers and the color developers each used in the above mentioned heat transfer recording layer, respectively.

As the sensitizer, there can be mentioned, for example, stearamide, palmitamide, oleamide, lauramide, ethylenebisstearamide, methylenebisstearamide and methylolstearamide.

Besides, there may be added adhesives such as a polyvinyl alcohol, starch, a sodium or ammonium salt of a styrene-maleic anhydride copolymer, a styrenebutadiene copolymer emulsion and the like and, as necessary, pigments such as titanium dioxide, calcium carbonate, kaolin, calcinated kaolin, aluminum hydroxide and the like.

Appropriate components are selected from the above mentioned materials and made into an aqueous dispersion; the dispersion is coated on a base sheet by a coater; the coated layer surface is made smooth by a super calender; thus a heat-sensitive recording layer is formed.

Microencapsulation of a color former or a color developer for obtainment of a microencapsulated color former or a microencapsulated color developer for use in the heat transfer recording layer can be conducted by a method known in the art. As the method, there can be mentioned, for example, a complex coacervation method, an in situ method, an interfacial polymerization method and a spray dry method.

In the heat transfer recording layer, there can be used, besides the essential components, such additives as a sensitizer, a low melting resin, a softening agent and the like.

As the base sheet of the heat-sensitive and heat transfer recording sheet of the present invention, a thin sheet is good in view of transfer characteristic. There can be used a condenser paper, a glassine paper and a resin film made of a polyester, a polyimide, a polycarbonate or a teflon, all of which are 10 to 30 $\mu$m in thickness.

Formation of the heat transfer recording layer on one side of a base sheet already provided with the heat-sensitive recording layer on the other side can be conducted, for example, by coating an aqueous coating color on the whole area of the one side of the base sheet by the use of an ordinary coater such as an air knife coater or the like, or by printing an aqueous coating color or a solvent dispersion on the part or whole area of the one side of the base sheet by the use of a flexographic printer or a gravure printer.

The present invention will specifically be described below by way of Examples. In the Examples, parts refers to parts by weight.

EXAMPLE 1

(1) Production of Microcapsules Containing a Color Former

In 100 parts of an aqueous solution of pH 4.0 containing 5% of a styrene-maleic anhydride copolymer and a small amount of sodium hydroxide, there was emulsified 80 parts of a 1,1-diphenylethane solution containing 8 parts of 3-diethylamino-6-methyl-7-phenylaminofluoran so that the emulsion particles had an average particle diameter of 6 to 7 μm. Separately, a mixture of 10 parts of melamine, 25 parts of an aqueous solution containing 37% of formaldehyde and 65 parts of water was adjusted to pH 9 with sodium hydroxide and then heated to 60° C. In 15 min, it became a transparent melamine-formaldehyde precondensate. This precondensate was added to the above obtained emulsion. The resulting mixture was heated to 60° C. and stirring was continued. In 30 min, formation of microcapsules was seen and then the mixture was cooled to room temperature. The microcapsules obtained had an average particle diameter of 7 μm.

(2) Production of Microcapsules Containing a Color Developer

In 100 parts of an aqueous solution of pH 4.0 containing 5% of a styrene-maleic anhydride copolymer and a small amount of sodium hydroxide, there was emulsified 80 parts of a 1,1-diphenylethane solution containing 24 parts of a p-phenylphenol-formaldehyde resin so that the emulsion particles had an average particle diameter of 4 to 5 μm. Separately, a mixture of 10 parts of melamine, 25 parts of an aqueous solution containing 37% of formaldehyde and 65 parts of water was adjusted to pH 9 and then heated to 60° C. In 15 min, it became a transparent melamine-formaldehyde precondensate. This precondensate was added to the above obtained emulsion. The resulting mixture was heated to 60° C. and stirring was continued. In 30 min, formation of microcapsules was seen and the mixture was cooled to room temperature. The microcapsules obtained had an average particle diameter of 5 μm.

(3) Production of a Heat-sensitive and Heat Transfer Recording Sheet (a) A coating color for the heat-sensitive recording layer was prepared as follows.

A color former (dye) and a color developer was separately dispersed as follows to preliminarily obtain a fluid A and a fluid B, respectively.

Fluid A (dispersion of color former)

150 g of 3-diethylamino-6-methyl-7-anilinofluoran was added to a mixture of 18 g of Malon MS-25 (a 25% aqueous solution of a sodium salt of a styrenemaleic anhydride copolymer manufactured by Daido Industries Corp.) and 332 g of water. The resulting mixture was subjected to grinding by a ball mill for 48 hr to obtain a dispersion.

Fluid B (dispersion of color developer)

150 g of bisphenol A was added to a mixture of 18 g of Malon MS-25 and 332 g of water. The resulting mixture was subjected to grinding by a ball mill for 48 hr to obtain a dispersion.

Using these fluids A and B and in accordance with the following composition, a heat-sensitive coating color was prepared. In the composition, parts refers to parts by weight of solid content.

| | |
|---|---|
| Calcium carbonate PC (Calcium carbonate manufactured by Shiraishi Kogyo Kaisha Ltd.) | 5.0 parts |
| Fluid A | 2.0 parts |
| Fluid B | 5.0 parts |
| Stearamide | 2.0 parts |
| Polyvinyl alcohol | 3.45 parts |

(b) The heat-sensitive coating color obtained above was coated on a surface-treated polyester film of 16 μm in thickness by the use of an air knife coater to form a heat-sensitive recording layer of 8 μm in thickness capable of developing a black color when a heat is applied.

On the non-coated side of the polyester film there was coated, by the use of an air knife coater, a mixture having the following composition and consisting of two kinds of the microcapsules produced in (1) and (2), an aqueous dispersion of solid 3-diethylamino-6-methyl-7-phenylaminofluoran and an aqueous dispersion of solid benzyl p-hydroxybenzoate and a paraffin wax emulsion so that the coated amount became about 5 g/m$^2$, whereby a heat transfer recording layer was formed and thus a heat-sensitive and heat transfer recording sheet was produced. In this sheet, the heat transfer recording layer had a very white color.

| | |
|---|---|
| Color former-containing microcapsules | 4 parts |
| Color developer-containing microcapsules | 8 parts |
| 3-Diethylamino-6-methyl-7-phenylaminofluoran | 8 parts |
| Benzyl p-hydroxybenzoate | 20 parts |
| Paraffin wax | 60 parts |

(4) Evaluation of Printability

The heat-sensitive and heat transfer recording sheet obtained in (3) was superimposed on a plain paper so that the heat transfer recording layer of the recording sheet faced the plain paper, and pressure printing was made on the recording sheet by the use of a ball pen to examine the pressure sensitivity of the recording sheet. A deep-color image could be obtained. For the same combination of the above recording sheet and the above plain paper, thermal printing was made on the recording sheet by the use of a facsimile tester manufactured by Matsushita Electric Components Co., Ltd. There were formed an image on the heat-sensitive recording layer of the recording sheet and a deep-color, clear, heat transferred image on the plain paper.

EXAMPLES 2 TO 3 AND COMPARATIVE EXAMPLES 1 TO 3

In the same manner as in Example 1, there were produced heat-sensitive and heat transfer recording sheets each different in the weight ratio of components of heat transfer recording layer from the recording sheet of Example 1. These sheets were evaluated for pressure sensitivity and heat transferability. The results are shown in the following table. In the table, O indicates a good result and X indicates a bad result.

TABLE

| | Example | | Comp. Example | | |
|---|---|---|---|---|---|
| | 2 | 3 | 1 | 2 | 3 |
| Color former-containing microcapsules, parts | 4 | 5 | 5 | 4 | 2 |
| Color developer-containing microcapsules, parts | 8 | 15 | 15 | 8 | 6 |
| 3-Diethylamino-6-methyl-7-phenylaminofluoran, parts | 8 | 10 | 2 | 8 | 10 |
| Benzyl p-hydroxybenzoate, parts | 20 | 30 | 8 | 20 | 30 |
| Paraffin wax, parts | 40 | 120 | 70 | 210 | 52 |
| Heat transferability | O | O | O | X | O |
| Pressure sensitivity | O | O | X | X | X |

As is obvious from the above table, Examples 2 and 3 gave good results in both heat transferability and pressure sensitivity.

What is claimed is:

1. A heat-sensitive and heat transfer recording sheet comprising a base sheet, a heat-sensitive recording layer provided on one side of the base sheet and a heat transfer recording layer provided on the other side of the base sheet, the heat transfer recording layer being formed by coating on the base sheet a coating color comprising 3 to 20 parts by weight of microcapsules containing a colorless, electron-donating color former, 3 to 30 parts by weight of microcapsules containing a colorless, electron-accepting color developer, 3 to 30 parts by weight of a solid of a colorless, electron-donating, color former, 10 to 50 parts by weight of a solid of a colorless, electron-accepting, color developer and 25 to 200 parts by weight of a wax.

2. A recording sheet according to claim 1, wherein the inner phase solution inside the microcapsules consists of 3 to 20% by weight of the color former and 97 to 80% by weight of a non-volatile solvent.

3. A recording sheet according to claim 1, wherein the inner phase solution inside the microcapsules consists of 20 to 50% by weight of the color developer and 80 to 50% by weight of a non-volatile solvent.

* * * * *